United States Patent [19]

Vignon

[11] Patent Number: 4,901,516

[45] Date of Patent: Feb. 20, 1990

[54] SPINNING DEVICE WITH BOBBIN CHANGER

[76] Inventor: Louis Vignon, Chemin de Vincy 5, CH-1201 Genève, Switzerland

[21] Appl. No.: 315,570

[22] Filed: Feb. 27, 1989

[30] Foreign Application Priority Data

Feb. 29, 1988 [CH] Switzerland ..... 743/88

[51] Int. Cl.[4] ..... D01H 9/08; D01H 9/02

[52] U.S. Cl. ..... 57/267; 57/276; 57/278

[58] Field of Search ..... 57/266, 267, 270, 274, 57/275, 276, 278

[56] References Cited

U.S. PATENT DOCUMENTS

| | | | |
|---|---|---|---|
| 3,380,238 | 4/1968 | Araki et al. | 57/267 |
| 3,681,905 | 8/1972 | Furtmeier et al. | 57/267 X |
| 3,935,699 | 2/1976 | Iida et al. | 57/267 |
| 4,369,621 | 1/1983 | Kogiso | 57/274 X |
| 4,805,352 | 2/1989 | Grassle et al. | 57/270 X |

FOREIGN PATENT DOCUMENTS

| | | |
|---|---|---|
| 643308 | 5/1984 | Switzerland . |
| 2089846 | 6/1982 | United Kingdom . |

*Primary Examiner*—John Petrakes

*Attorney, Agent, or Firm*—Young & Thompson

[57] ABSTRACT

The spinning device comprises a vertically displaceable spindle bearing plate (2) carrying a rotatable spindle (1), and a cap-shaped thread guide member (6) rotatable about the spindle axis. The bobbin changer has a supporting element (11) and a bobbin holder element (10) which are movable transversely to the spindle axis. An extension (9) is releasably mounted on the top end of the spindle (1) and/or of a bobbin tube (8) placed on the spindle. Once the bobbin tube (8) has been fully wound with yarn, a short yarn section is wound onto this extension (9), and then the spinning device is shut off. The spindle bearing plate (2) is lowered, and the supporting element (11) is moved toward the spindle axis in order to seize the extension (9). The spindle bearing plate (2) is lowered further, and the bobbin holder element (10) is moved toward the spindle axis, seizes the fully wound bobbin tube (8), and transfers the latter to a conveying means (14, 15). Subsequently, the bobbin holder element (10) moves an empty bobbin tube (8) from the conveying means (14, 15) into the axis of the spindle. Then the spindle bearing plate (2) is lifted in order to introduce the spindle (1) into the empty bobbin tube (8). The supporting element (11) places the extension (9) onto the upper end of the bobbin tube (8) and withdraws.

5 Claims, 2 Drawing Sheets

SPINNING DEVICE WITH BOBBIN CHANGER

The invention relates to a bobbin changer in a spinning device.

A spinning device of the indicated type has been known, for example, from the reference CH-A 643,308. The extension attachable to the free end of the spindle and/or of the bobbin serves for winding a short yarn section beside the bobbin before the latter is removed from the spindle. The extension is needed, in particular, if it is impossible to wind the short yarn section beside the other end of the bobbin, for example, onto the spindle, for example because the full bobbin has no longer any room in the cap-shaped thread guide member on account of limited dimensions of the latter.

It is an object of the invention to provide a bobbin changer capable of performing a bobbin change at a spinning device of the indicated type in a completely automatic fashion and in a simple way.

Figure 1:
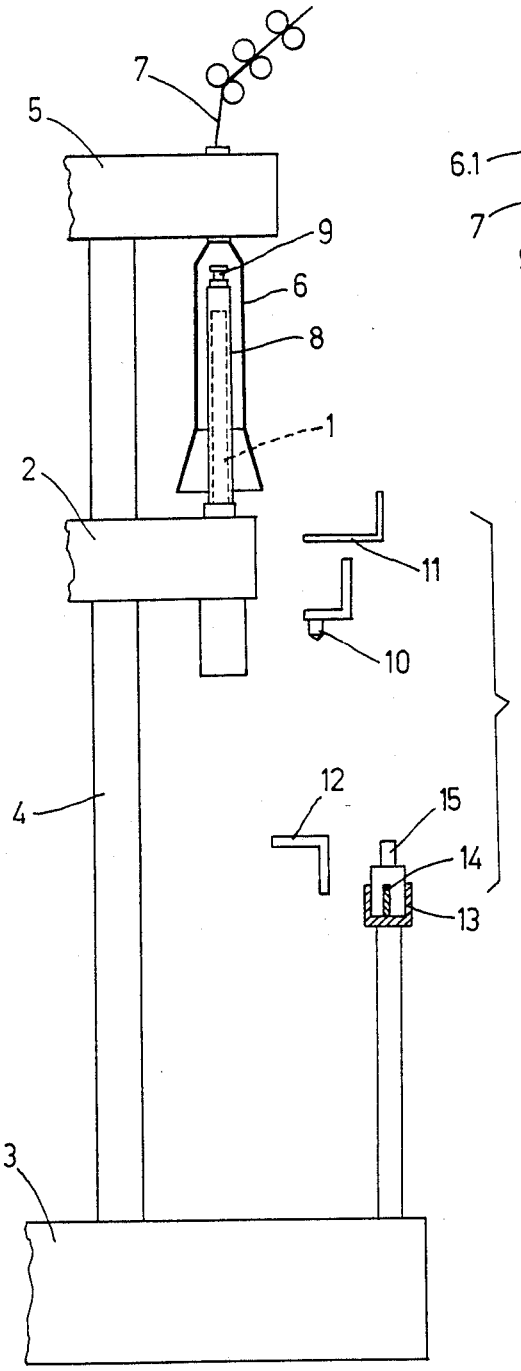
Figure 2:
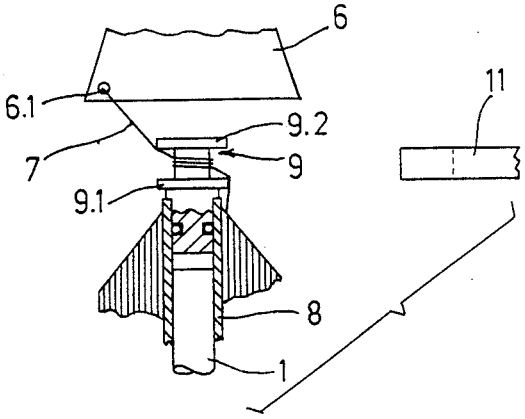
Figure 3:
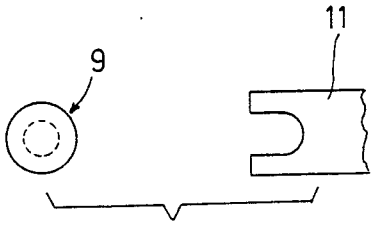

One embodiment of the present invention will be described below in greater detail with reference to the drawings wherein:

FIG. 1 illustrates schematically a lateral view of a spinning device with elements of the bobbin changer, FIG. 2 shows, on an enlarged scale and partially in section, the upper end of the bobbin in the spinning device, with the extension mounted thereon, FIG. 3 shows a top view of FIG. 2, and FIGS. 4 through 21 show the spinning device on a reduced scale at various positions of the components during a bobbin changing procedure.

The illustrated spinning device comprises, as is usual, a spindle 1 rotatable about its axis and carried by a spindle bearing plate 2. The rotary drive mechanism for the spindle 1, normally a belt, not shown, is accommodated in the spindle bearing plate 2. The spindle bearing plate 2 is guided to be vertically displaceable along columns 4 standing on a base 3. The shifting drive means for the spindle bearing plate 2, for example chains traveling over drivable chain wheels, is not illustrated, either. A bracket 5 is arranged on the top end of the columns 4, a cap-shaped thread guide member 6 coaxial to the spindle 1 being rotatably supported in this bracket. The bracket 5 likewise contains a drive and/or braking mechanism, not shown, for the thread guide member 6. The thread 7 arriving from a drafting unit enters from above into the thread guide member 6 in the axis of the latter and then travels in the interior of the thread guide member 6 up to its lower rim. At this lower rim, the thread passes through a guide opening 6.1 (shown only in FIG. 2) and is then wound up on a bobbin tube 8 arranged on the spindle 1.

An extension 9 is releasably placed on the top end of the spindle 1 and/or of the bobbin tube 8, a yarn section of limited length being wound onto this extension prior to a bobbin change.

The bobbin change is performed by an automatically operating bobbin changer, the essential elements of which are the following: A bobbin holder element 10, a first supporting element 11, and a second supporting element 12. The bobbin holder element 10 and the supporting elements 11 and 12 are each movable, by a drive means, not shown, transversely to the axis of the spindle 1. The bobbin holder element 10 can have the shape of an elastic pin, for example, that can be inserted in the upper end of a bobbin tube 8 in order to retain the bobbin tube and, respectively, the bobbin. The first supporting element 11 can be a bifurcate element, as illustrated in FIG. 3, which can be pushed between flanges 9.1 and 9.2 (FIG. 2) of the extension 9 in order to retain the extension 9 against axial displacement. The second supporting element 12 can likewise be a bifurcate member that can be placed underneath a bobbin member in order to retain same against axial shifting.

Furthermore, a conveying means for empty bobbin tubes 8 and full bobbins is arranged on the base 3, for example in the form of a belt 14, traveling in a rail 13 perpendicularly to the plane of the drawing, on which are carried pins 15 for placing respectively one bobbin or bobbin tube thereon.

An automatically operating control device (not illustrated) is provided for controlling the drive mechanisms of the bobbin holder element 10 and of the supporting elements 11 and 12, as well as of the drive means for the vertical shifting of the spindle bearing plate 2 and of the drive means for the conveyor belt 14 during a bobbin changing operation This control device brings about the movements of the described components as elaborated on below with reference to FIGS. 4–21.

Figure 4:
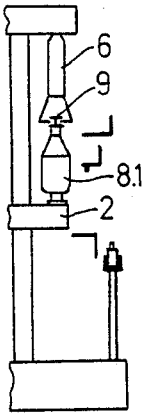

Prior to shutting off the spinning device (i.e. the rotary drive mechanisms of the spindle 1 and of the cap-shaped thread guide member 6), the spindle bearing plate 2 is adjusted to the level indicated in FIG. 4 so that the extension 9 at the top end of the full bobbin 8.1 is oriented toward the bottom rim of the thread guide member 6. A yarn section of limited length is wound onto the extension 9. Then the spinning device is shut off.

Figure 5:
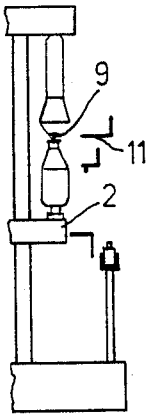

Subsequently, the spindle bearing plate 2 is lowered to the level shown in FIG. 5 in order to align the extension 9 to the height of the first supporting element 11. FIG. 2 likewise shows the parts in this position.

Figure 6:
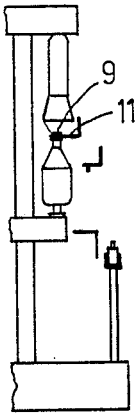

Then, according to FIG. 6, the first supporting element 11 is moved to a location in the continuation of the spindle axis so that at this point the first supporting element 11 carries the extension 9 and retains same against further axial displacement.

Figure 7:
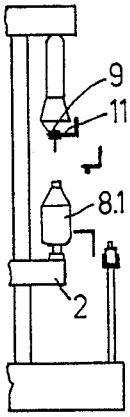

Thereafter the spindle bearing plate 2, with the bobbin 8.1 located on the spindle, is lowered into the position according to FIG. 7, the extension 9 being retained by the supporting element 11, and the thread breaking between the extension 9 and the bobbin 8.1, for example on a sharp edge and/or in a notch of the bottom flange 9.1 of extension 9.

Figure 8:
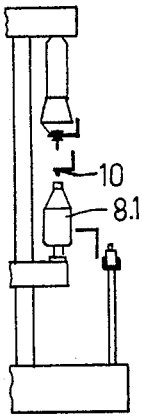

Subsequently, as shown in FIG. 8, the bobbin holder element 10 is moved to a location above the bobbin 8.1 in the continuation of the spindle axis.

Figure 9:
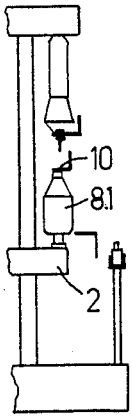

Then the spindle bearing plate 2 is again somewhat raised so that the bobbin holder element 10, as shown in FIG. 9, enters the top end of the bobbin 8.1 in order to retain same.

Figure 10:
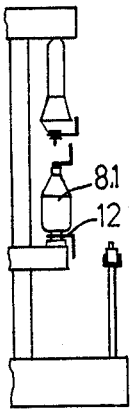

Thereafter, as illustrated in FIG. 10, the second supporting element 12 is shifted to underneath the bobbin 8.1 in order to retain the latter against axial displacement in the downward direction. The second supporting element 12 is required, in particular, in case the spindle 1 and the bobbin tube 8 are somewhat conical and therefore adhere firmly to each other.

Figure 11:
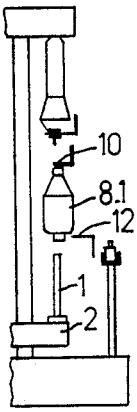

Subsequently the spindle bearing plate 2 is lowered completely to the bottom, into the position shown in FIG. 11, in order to pull the spindle 1 out of the bobbin 8.1 held by the bobbin holder element 10 and by the second supporting element 12. The second supporting element 12 is thereafter retracted again into its initial position beside the spindle.

Figure 12:
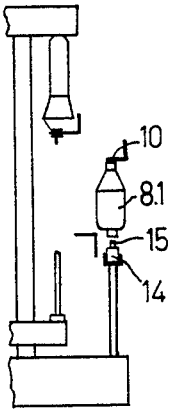

The bobbin holder element 10 with the bobbin 8.1 is then moved into the position, shown in FIG. 12, above an empty pin 15 of the conveyor belt 14.

Figure 13:
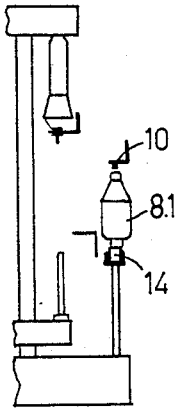

Thereafter the bobbin holder element 10 places the bobbin 8.1 onto the aforementioned pin 15 of the conveyor belt 14 and then withdraws in the upward direction from the bobbin 8.1 as illustrated in FIG. 13. (The pin 15 of the conveyor belt retains the bobbin 8.1 with a force greater than the bobbin holder element 10.)

Figure 14:
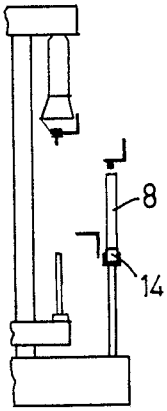

The conveyor belt 14 is then moved further by one step (=half a spindle pitch) perpendicularly to the plane of the drawing in order to carry away the full bobbin 8.1 and to put an empty bobbin tube 8 in its place (FIG. 14).

Figure 15:
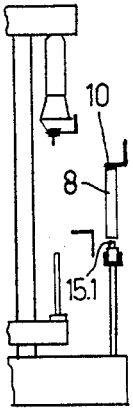

The bobbin holder element 10 then enters the bobbin tube 8 from above and pulls the latter off its conveyor belt pin 15.1, see FIG. 15. (The pin 15.1 retains the bobbin tube 8 with less force than the bobbin holder element 10.)

Figure 16:
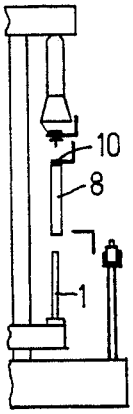

Then the bobbin holder element 10 with the bobbin tube 8 is again moved to the location in the continuation of the spindle axis, as shown in FIG. 16.

Figure 17:
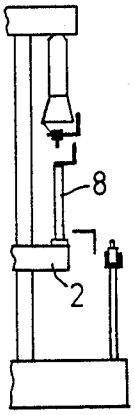

Subsequently the spindle bearing plate 2 is raised so that the spindle 1, as illustrated in FIG. 17, enters the bobbin tube 8 and seizes therein.

Figure 18:
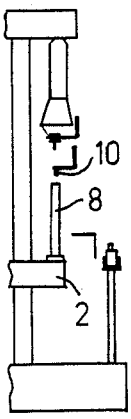

The spindle bearing plate 2 is then again lowered somewhat with the bobbin tube 8, as shown in FIG. 18, in order to detach the bobbin tube from the bobbin holder element 10.

Figure 19:
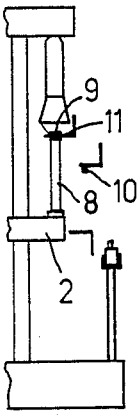

The bobbin holder element 10 is subsequently retracted, as illustrated in FIG. 19, into its position beside the spindle, and the spindle bearing plate 2 is raised with the bobbin tube 8 until the extension 9, carried by the first supporting element 11, enters the top end of the bobbin tube 8.

Figure 20:
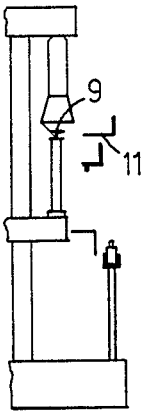

At this point in time, the first supporting element 11 can again be withdrawn from the extension 9, see FIG. 20.

Figure 21:
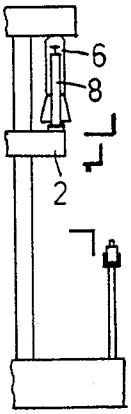

The spindle bearing plate 2 is then raised further, and the spinning device again starts operation as soon as the extension 9, with the short yarn section wound thereon, enters the cap-shaped thread guide member 6. FIG. 21 shows the position with a completely raised spindle bearing plate 2 wherein the formation of the new winding is begun on the bottom end of the bobbin tube 8.

What is claimed is:

1. A bobbin changer for use in combination with a spinning device which device includes a rotatable and axially displaceable spindle, a thread guide member coaxial to the spindle and rotatable about the axis of said spindle, and an extension releasably extending from a free end of said spindle for winding thereupon a section of yarn of definite length prior to changing said bobbin, said bobbin changer comprising a bobbin holder means, said bobbin holder means movable in a direction transverse to the axis of said spindle between a first position intersecting said spindle axis to a second position adjacent said spindle, said bobbin holder means capable of cooperative engagement with said bobbin to permit said bobbin holder means to remove a full bobbin from said spindle and transfer said bobbin to said second position, said bobbin holder means also capable of cooperative engagement with an empty bobbin and to transfer said empty bobbin from said second position to said first position, first support means adapted to restrain said extension from lateral displacement, said first support means movable in a direction transverse to said axis of said spindle from a position adjacent said spindle to a position intersecting said spindle axis and in engagement with said extension.

2. A bobbin changer according to claim 1, further comprising a second supporting means capable of cooperative engagement with said bobbin and of being advanced transversely to said spindle axis to retain a bobbin positioned on said spindle in place and to avoid axial shifting of said bobbin in relation to said spindle.

3. A bobbin changer according to claim 2, further comprising means for axially displacing said spindle along an axial direction to effect detachment of said spindle from said extension as well as from said full bobbin and to effect cooperative engagement of said spindle with an empty bobbin.

4. A bobbin changer according to claim 3, wherein said means to axially displace said spindle comprises a spindle support plate which plate is axially shiftable.

5. A bobbin changer according to claim 1, further comprising means to support said full bobbin upon being transferred to said second position.

* * * * *